US008561852B2

(12) United States Patent
Maas et al.

(10) Patent No.: US 8,561,852 B2
(45) Date of Patent: Oct. 22, 2013

(54) DOSING HEAD FOR DISPENSING A FLUID FROM A CONTAINER

(75) Inventors: Wilhelmus Johannes Joseph Maas, Someren (NL); Petrus Lambertus Wilhelmus Hurkmans, Someren (NL)

(73) Assignee: Dispensing Technologies, B.V., Helmond (NL)

( * ) Notice: Subject to any disclaimer, the term of this patent is extended or adjusted under 35 U.S.C. 154(b) by 1253 days.

(21) Appl. No.: 11/909,070

(22) PCT Filed: Mar. 21, 2006

(86) PCT No.: PCT/NL2006/000150

§ 371 (c)(1),
(2), (4) Date: Mar. 21, 2008

(87) PCT Pub. No.: WO2006/101388

PCT Pub. Date: Sep. 28, 2006

(65) Prior Publication Data

US 2008/0277430 A1 Nov. 13, 2008

(30) Foreign Application Priority Data

Mar. 21, 2005 (NL) ..... 1028577

(51) Int. Cl.
*B67D 7/58* (2010.01)

(52) U.S. Cl.
USPC ..... 222/383.1; 222/188

(58) Field of Classification Search
USPC ..... 222/376, 383.1, 321.4, 188, 321.7, 222/402.19
See application file for complete search history.

(56) References Cited

U.S. PATENT DOCUMENTS

| | | | | |
|---|---|---|---|---|
| 5,897,032 | A * | 4/1999 | Ellion et al. | 222/189.1 |
| 5,979,712 | A * | 11/1999 | Montaner et al. | 222/321.4 |
| 6,942,125 | B2 * | 9/2005 | Marelli | 222/321.4 |
| 2005/0098585 | A1 * | 5/2005 | Marelli | 222/321.9 |

FOREIGN PATENT DOCUMENTS

| | | | |
|---|---|---|---|
| JP | 11019544 | A | 1/1999 |
| JP | 11222252 | A | 8/1999 |

* cited by examiner

*Primary Examiner* — Kevin P Shaver
*Assistant Examiner* — Robert Nichols, II
(74) *Attorney, Agent, or Firm* — Kramer Levin Naftalis & Frankel LLP

(57) ABSTRACT

A dosing head for dispensing a fluid from a container is presented. The dosing head has an inlet opening connected to the container, an outlet opening connected to the inlet opening via a conduit, a pump provided in the conduit, and a aerating opening. The dosing head can be used in an upside down position. A liquid seal is arranged between the aerating opening and the container. The seal can include an aerating channel that is rotated twice through about 180° and which can be assembled from two mutually connected parts. The liquid seal can have a restriction which prevents liquid form reaching the aerating opening when upside down.

17 Claims, 10 Drawing Sheets

DOSING HEAD FOR DISPENSING A FLUID FROM A CONTAINER

Figure 1:
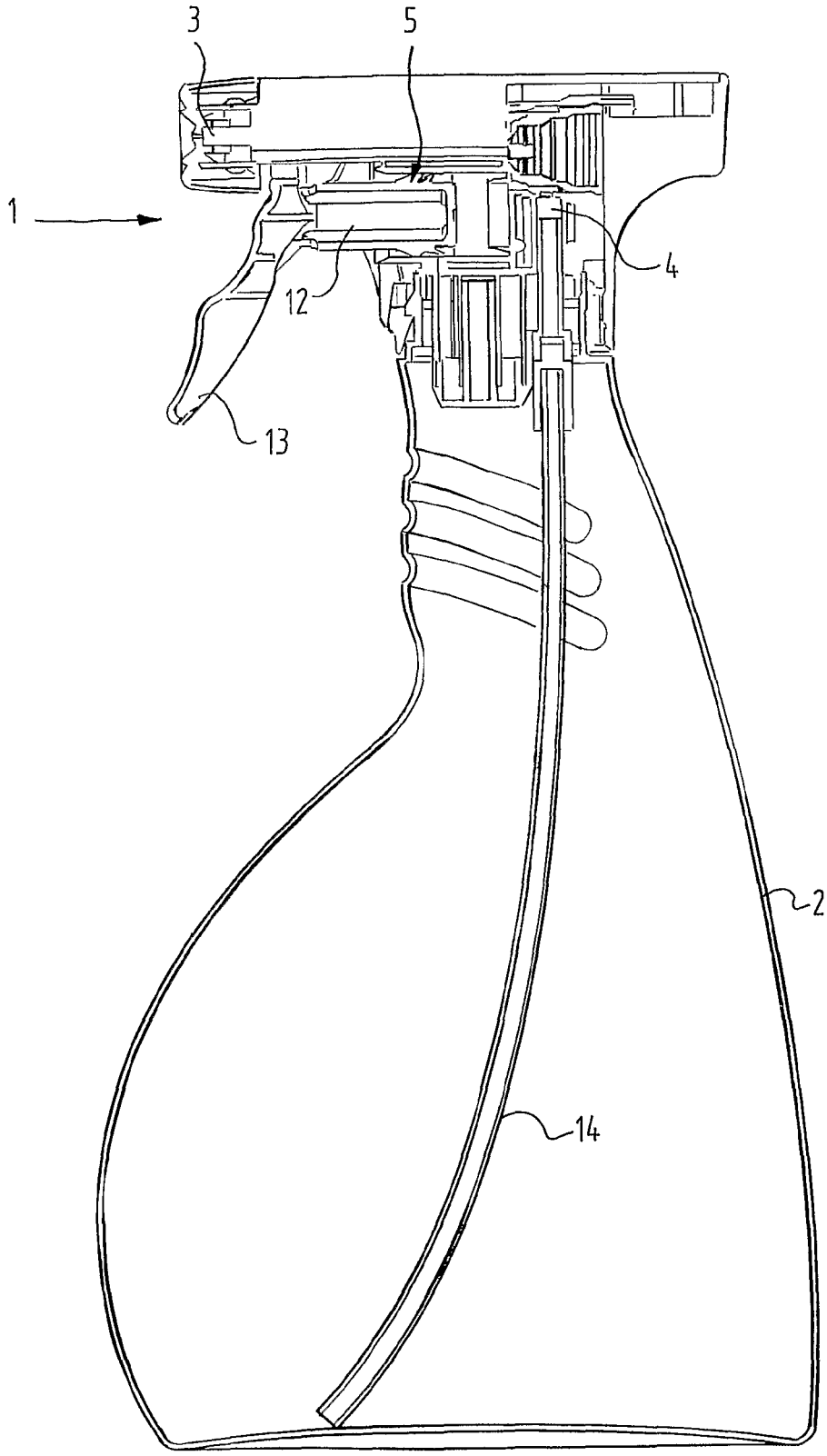

The invention relates to a dosing head for dispensing a fluid from a container, comprising at least one inlet opening for connecting to the container, at least one outlet opening connected to the inlet opening via a conduit, at least one pump received in the conduit and at least one aerating opening for connecting to the container. Such a dosing head is known, for instance from WO 00/33970.

The known dosing head has the drawback that it can only be used in almost vertical position, since fluid otherwise escapes through the aerating opening, while in addition no more fluid is drawn in by the dip tube which protrudes into the container and which is connected to the dosing head.

The invention therefore has for its object to provide a dosing head of this type which can also be used in other positions. According to a first aspect of the invention this is achieved in that a liquid seal is arranged between the aerating opening and the container. Leakage of fluid through the aerating opening is thus prevented.

In order to prevent the escape of fluid through the aerating opening as far as possible, the liquid seal preferably comprises an aerating channel rotated at least twice through about 180°. In order to be able to draw out from the liquid seal liquid which has penetrated therein, it is further recommended that the liquid seal has at least one restriction.

From production engineering considerations it is advantageous when the liquid seal is assembled from at least two mutually connected parts. The component parts can thus be easily manufactured by injection moulding and then be clamped or clicked into each other.

An effective liquid seal, which is easy to manufacture, is obtained when each of the parts has a bottom, a side wall and a tubular part protruding from the bottom, wherein the tubular parts fit into each other with clearance and wherein the bottom of the one part has an opening outside the periphery of the tubular part and the bottom of the other part has an opening inside the periphery of the tubular part.

In order to limit as far as possible the number of separate components of which the dosing head consists, it is recommended that the pump, the inlet opening, the outlet opening and the conduit situated therebetween are formed as one component, and one of the parts of the liquid seal is integrated into this component.

A structurally simple embodiment is then achieved when the restriction is defined between the component parts of the liquid seal.

Conversely, it is also possible for the liquid seal to be releasably coupled to the dosing head. The liquid seal can thus be added in simple manner to an existing design of a dosing head.

According to a second aspect, the invention provides a dosing head which is provided with a secondary inlet opening to be connected to the container and closable by means of an element which can be operated by gravity. In the one position of the container the fluid can thus be drawn in through the primary inlet opening, while the secondary inlet opening is then closed by the closing element, which is urged thereon by the force of gravity. In the other position of the container the closing element is lifted from the secondary inlet opening by gravity, which is thereby left clear for the passage of fluid.

In order to have closing and releasing of the secondary inlet opening take place in well-defined manner, the secondary inlet opening is preferably accommodated in a secondary inlet channel rotated at least twice through about 180'. The secondary inlet channel can herein then have an inflow chamber in which the closing element is received in freely movable manner with clearance, which inflow chamber comprises an end wall which is directed toward the container and in which the secondary inlet opening is defined so that the fluid can readily flow past the sealing element in the one position, and the secondary inlet opening is sealed in reliable manner in the other position.

For an optimal flow of the fluid, irrespective of the dosing head position, the secondary inlet channel preferably comprises an outlet part which is connected to the primary inlet opening. In order to prevent the fluctuations in the flow through the dip tube—when the container is upright—it is recommended that between the primary inlet opening and the container a constriction is formed, the throughflow area of which is smaller than that of the secondary inlet opening.

In order to also enable simple manufacture and mounting of the secondary inlet channel, at least a part of the secondary inlet channel is preferably connected releasably to the dosing head.

For structural reasons it is recommended that at least a part of the secondary inlet channel is connected releasably to the liquid seal, for instance the part of the secondary inlet channel clamped between a part of the liquid seal and the primary inlet opening, so that the different channels can be defined by a number of injection moulded parts.

Finally, the invention further relates to an assembly of a container and a dosing head as described above.

Figure 2:
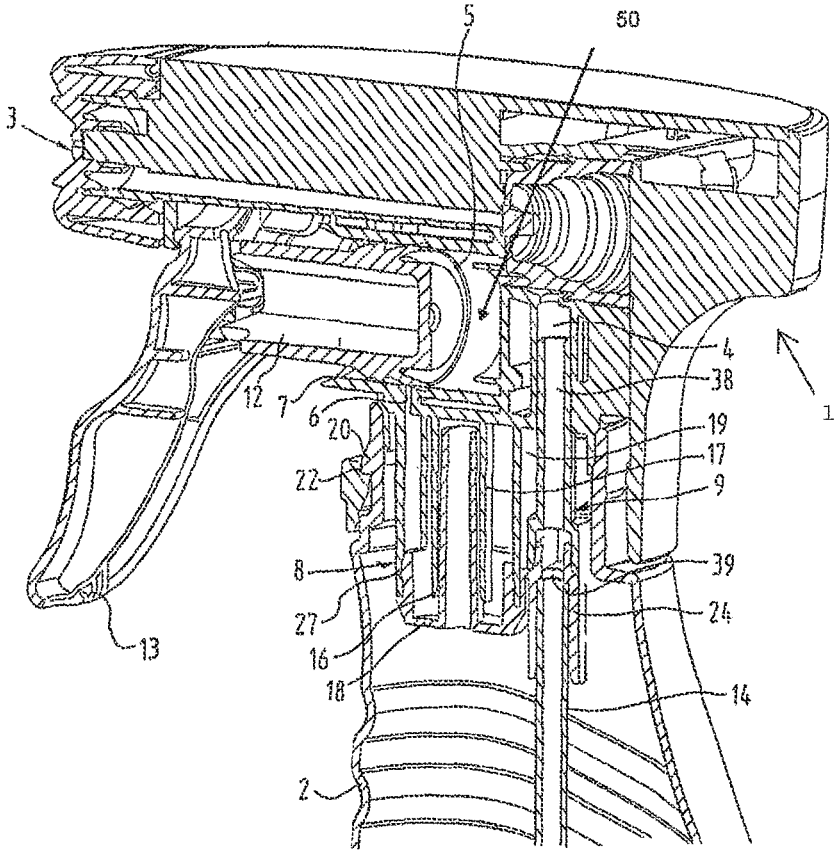
Figure 3:
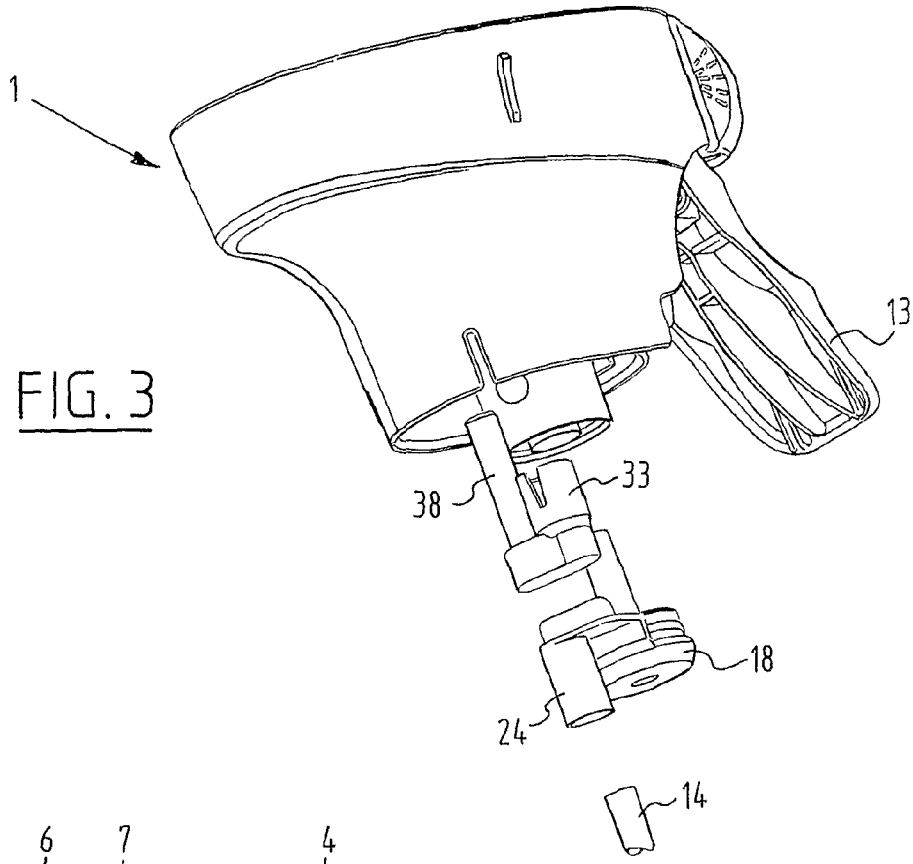
Figure 9:
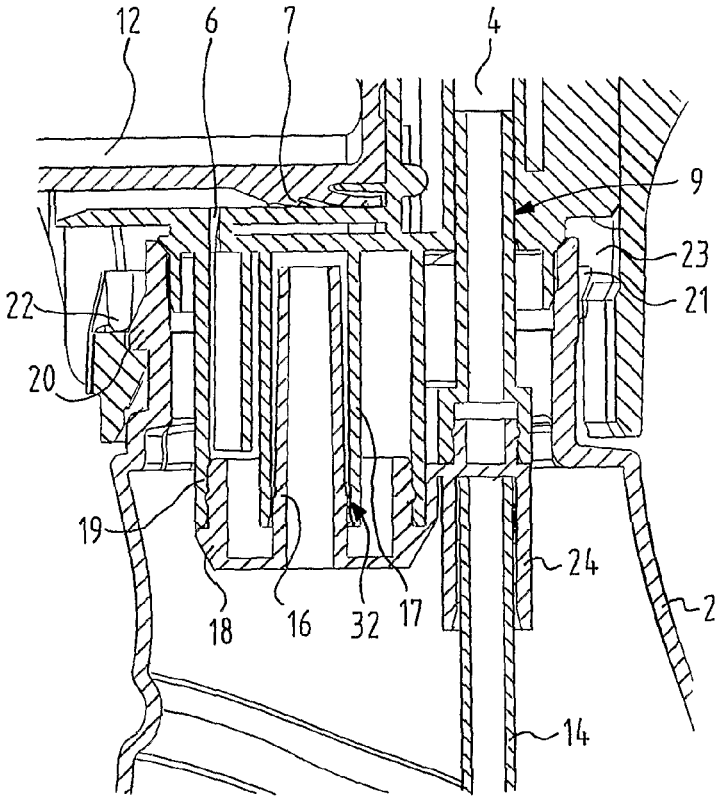
Figure 4C:
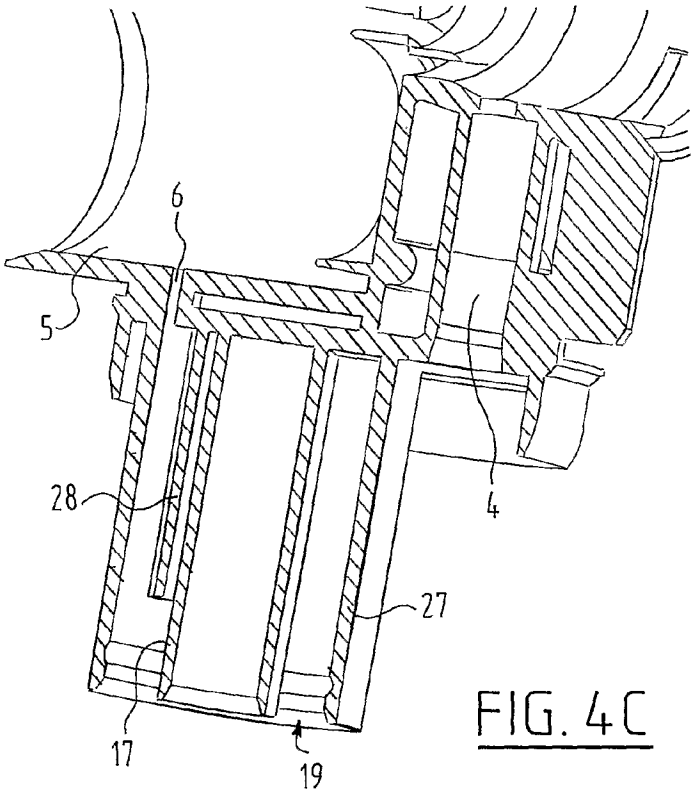
Figure 4A:
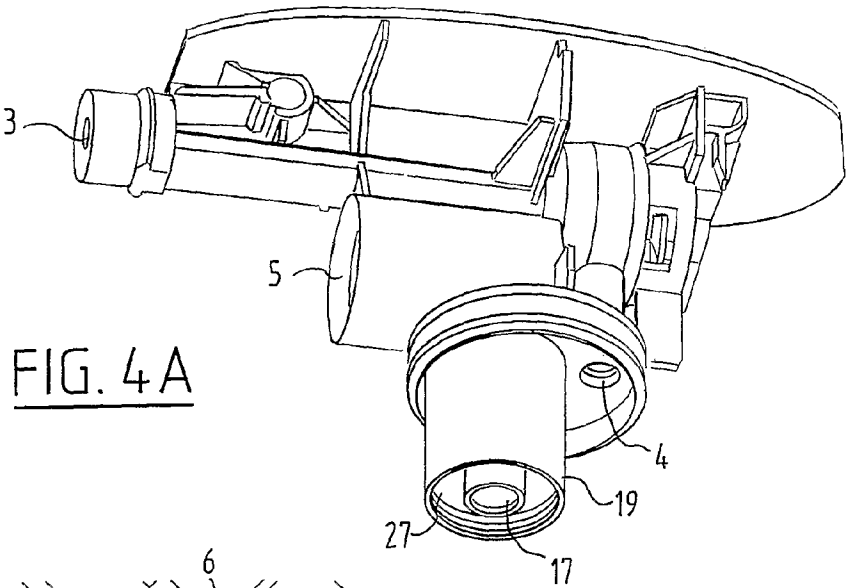
Figure 4B:
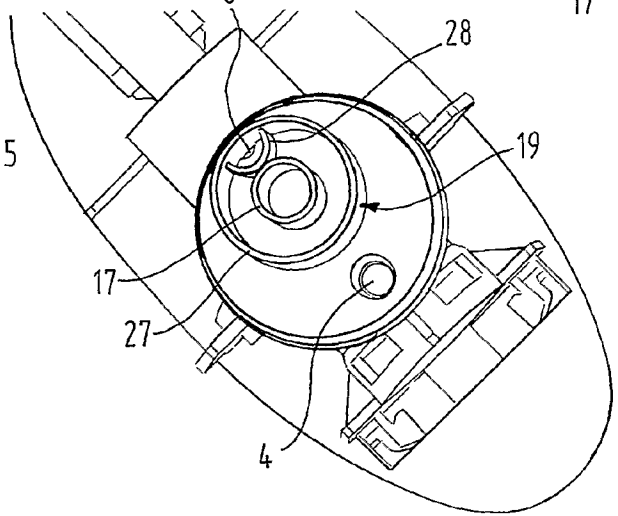
Figure 6C:
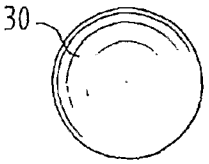
Figure 6B:
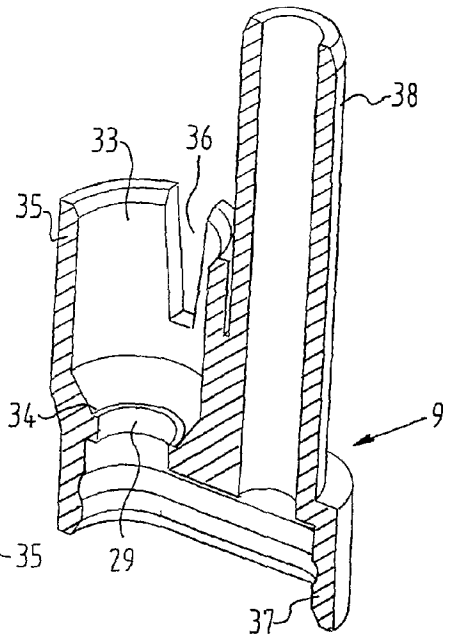
Figure 6A:
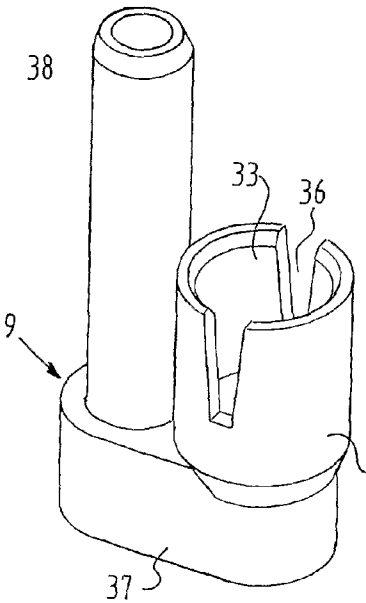
Figure 5B:
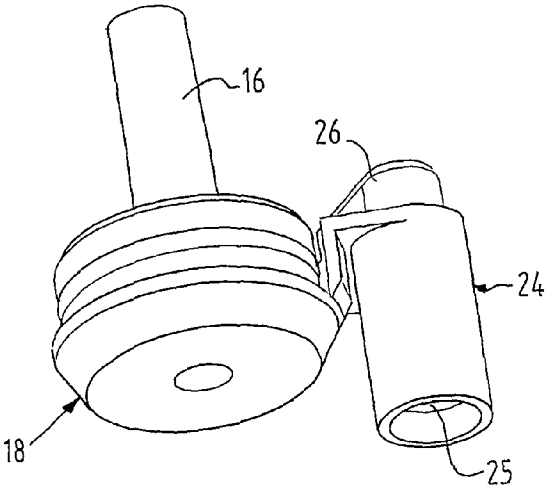
Figure 5A:
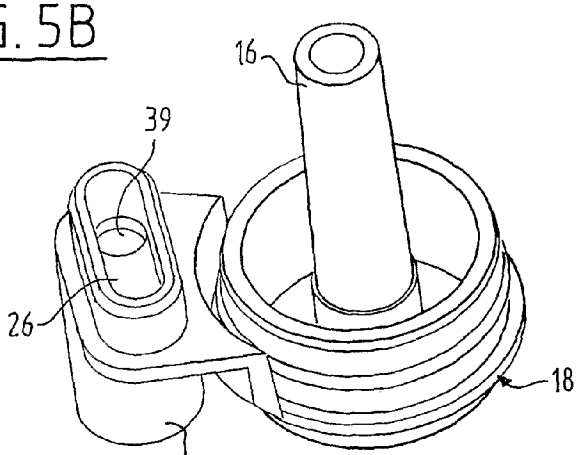
Figure 8:
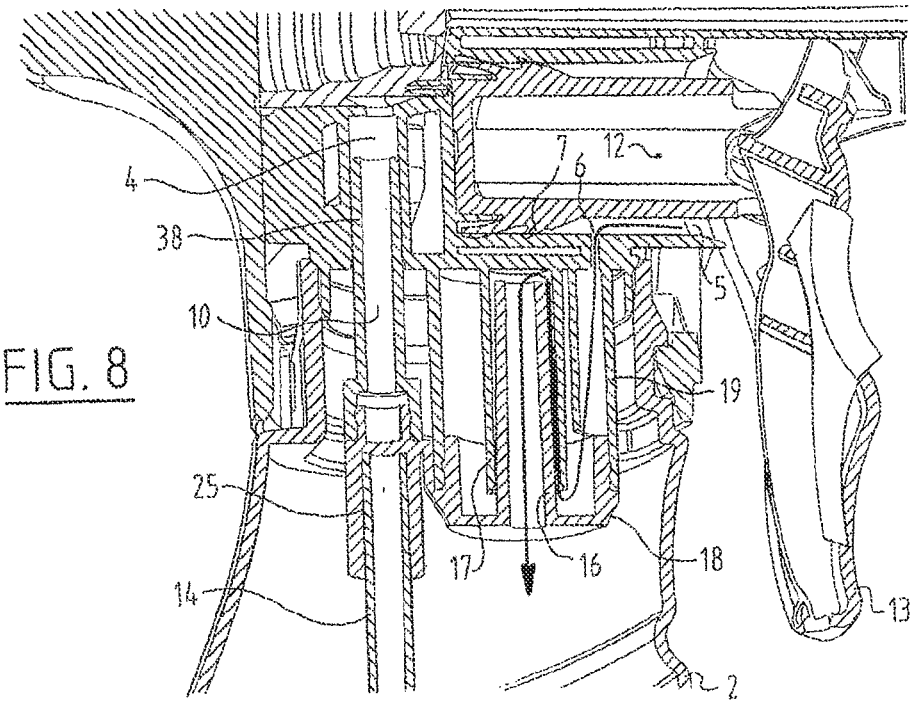
Figure 7:
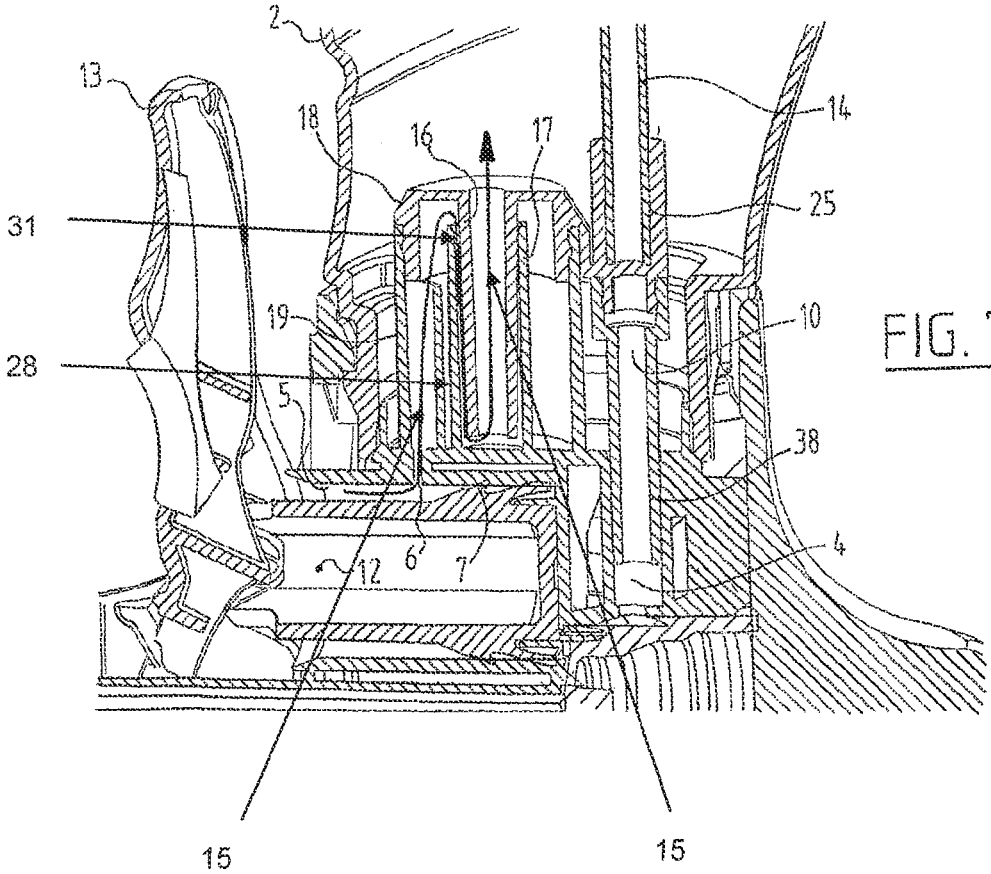
Figure 11:
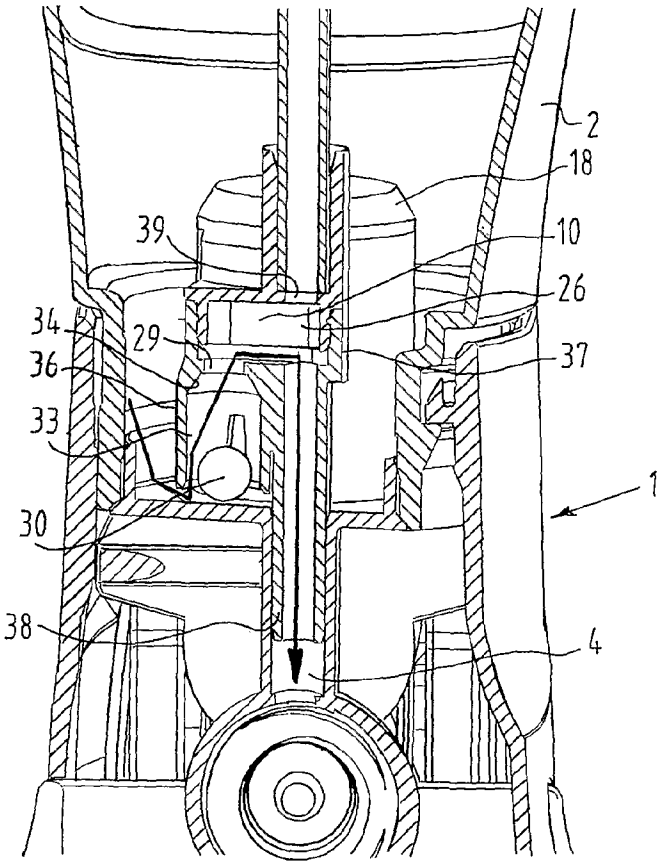
Figure 10:
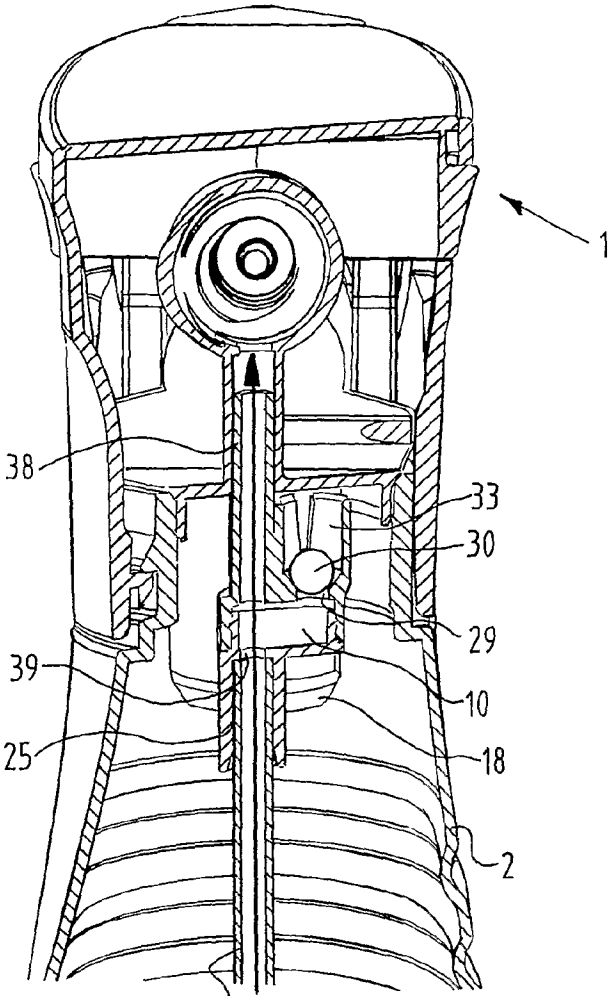
Figure 12:
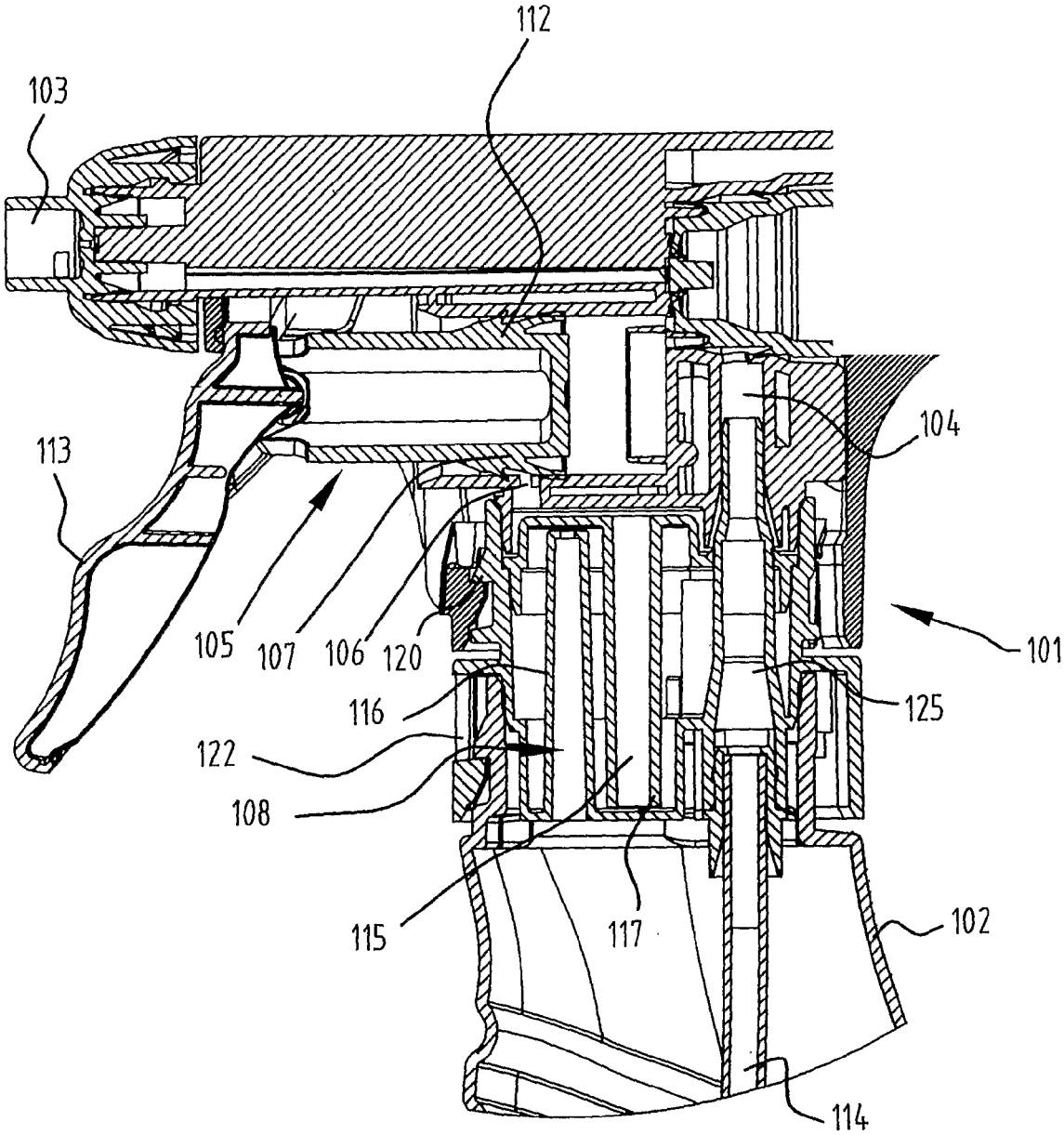
Figure 15A:
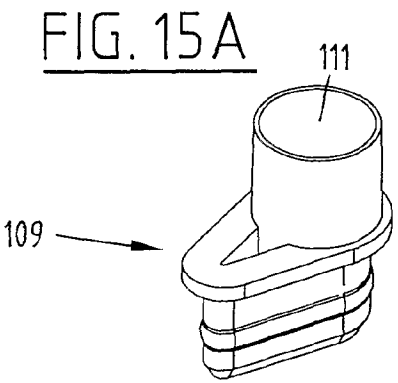
Figure 15B:
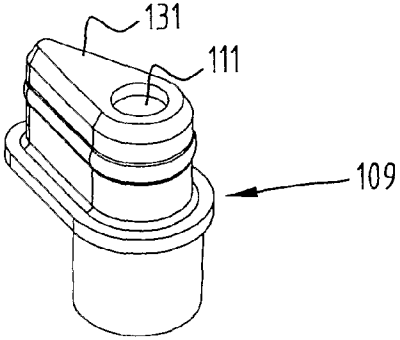
Figure 14A:
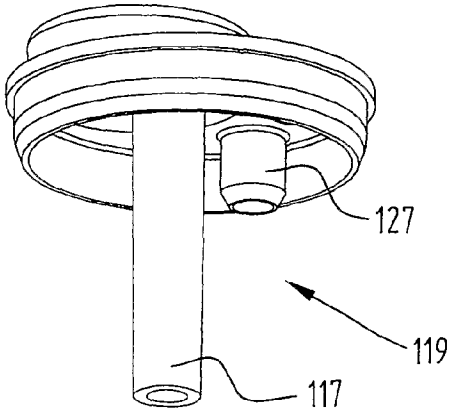
Figure 14B:
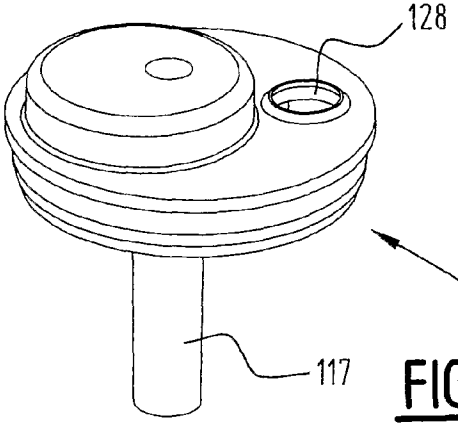
Figure 13A:
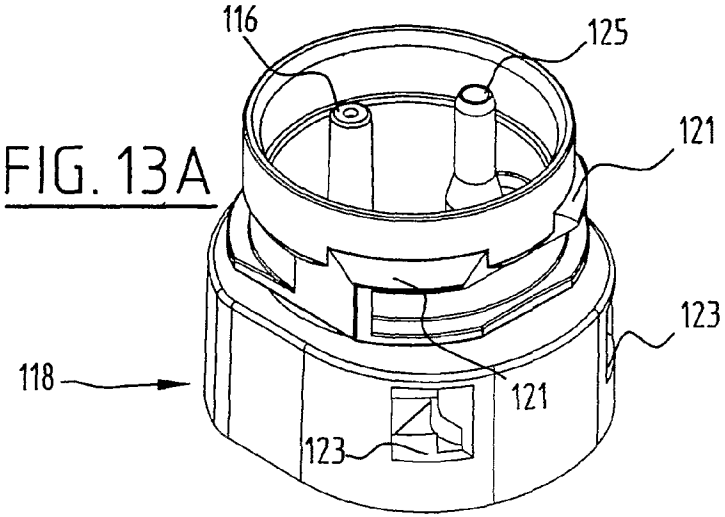
Figure 13B:
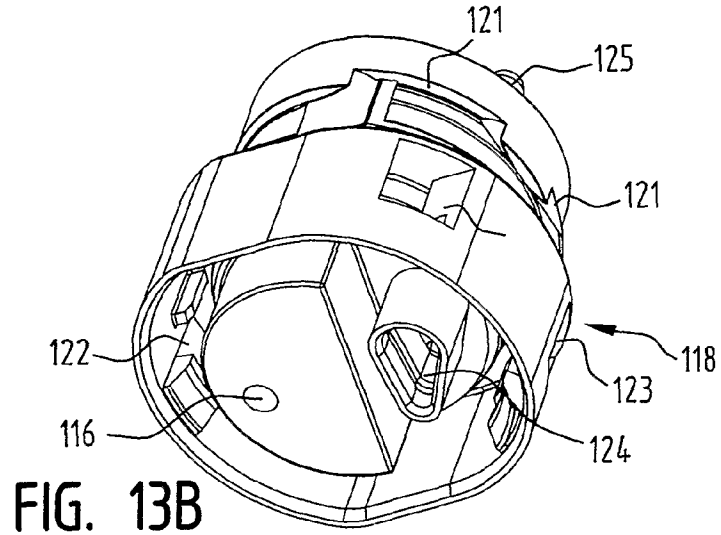
Figure 16:
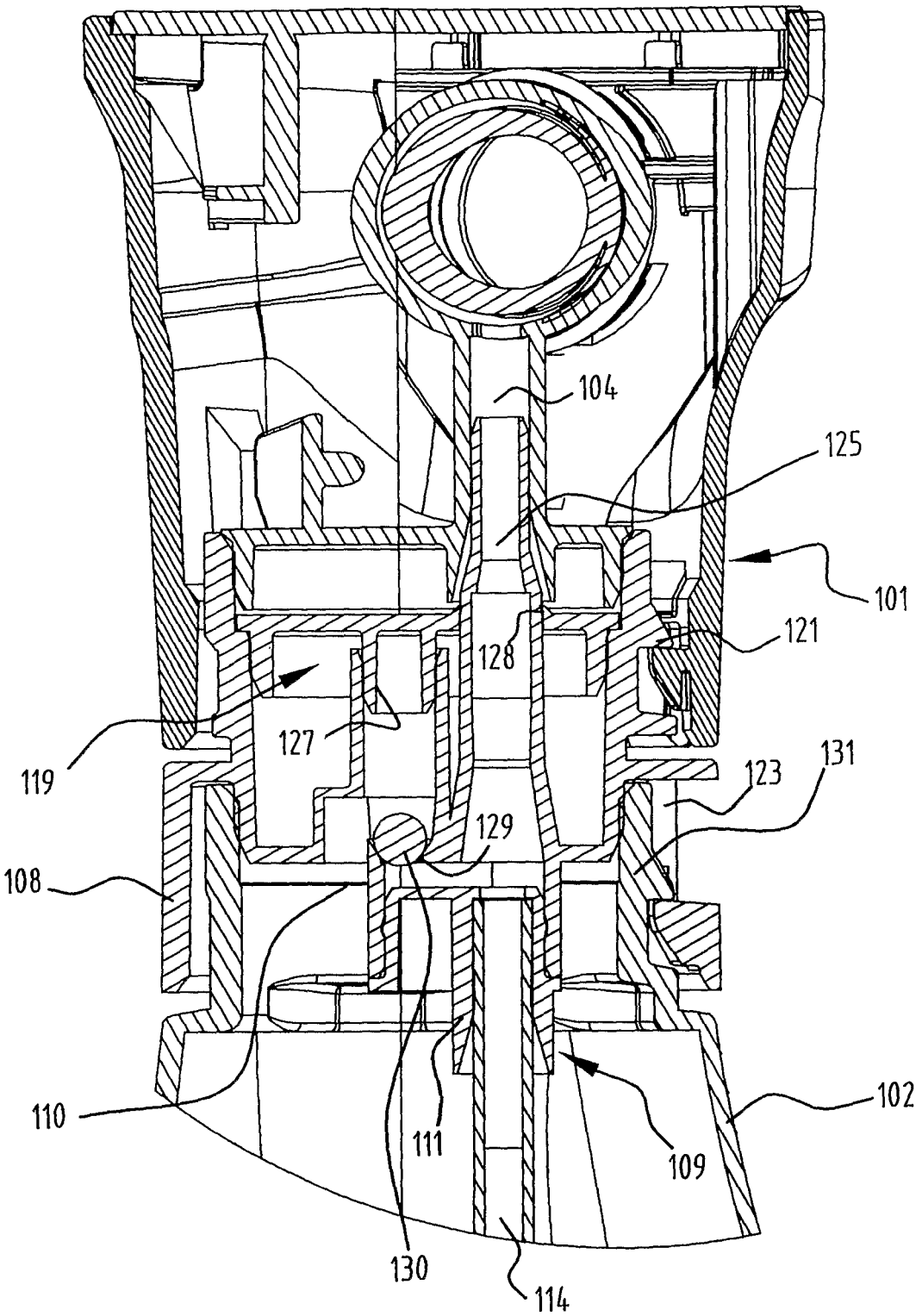

The invention will now be elucidated on the basis of two embodiments, wherein reference is made to the accompanying drawing, in which corresponding components are designated with reference numerals which are increased by "100", and in which:

FIG. 1 is a partly cross-sectional side view of an assembly of a container and a dosing head according to a first embodiment of the invention, FIG. 2 is a cross-sectional perspective view of a part of the assembly of FIG. 1, FIG. 3 is a perspective view with exploded parts of the dosing head, the secondary inlet opening and the liquid seal, FIGS. 4A, 4B and 4C show respectively a perspective bottom view, a plane bottom view and a cross-sectional perspective view of a main part of the dosing head, into which a part of the liquid seal is integrated, FIGS. 5A and 5B show respectively a perspective top view and a perspective bottom view of a part of the liquid seal, FIGS. 6A and 6B show respectively a perspective top view of the secondary inlet channel and a cross-section thereof from the other side, FIG. 6C is a perspective view of the sealing element for the secondary inlet opening, FIGS. 7 and 8 show a longitudinal section of the dosing head in a standing and an upside down operating position, FIG. 9 is a cross-section through the liquid seal, in which the restriction can be seen, FIGS. 10 and 11 are cross-sectional front views of the container with dosing head during use in upright respectively upside down position, FIG. 12 is a longitudinal section through a dosing head according to a second embodiment of the invention, FIGS. 13A and 13B show respectively a perspective top view and bottom view of a main part of the liquid seal and the secondary inlet channel of this embodiment, FIGS. 14A and 14B show respectively a perspective bottom view and top view of a part closing the main part of FIG. 13, FIGS. 15A and 15B show respectively a perspective bottom view and a perspective top view of a third component of the liquid seal and secondary inlet channel of the dosing head according to FIG. 12, and FIG. 16 is a diagonal cross-section through the dosing head of FIG. 12, in which the position of the secondary inlet channel is shown.

A dosing head 1 for dispensing a liquid or other fluid from a container 2 (FIG. 1) comprises an inlet opening 4 which is connected via a conduit 50 to an outlet opening 3 (FIG. 2). Accommodated in the conduit is a pump 5 with a reciprocally movable piston 12 which is operated by a handle or trigger 13. Dosing head 1 further has an aerating opening 6 through which air can enter container 2 when fluid is pumped therefrom in order to prevent an underpressure forming in container 2. When trigger 13 and piston 12 of pump 5 are in the protruding rest position, aerating opening 6 is closed by a peripheral lip 7 of piston 12, which leaves opening 6 clear during a pumping stroke when piston 12 is moved inward. Inlet opening 4 of dosing head 1 is connected to a dip tube 14 which extends to a position close to the bottom of the container. Up to this point dosing head 1 is conventional.

So as to also enable use of dosing head 1 when the assembly of container 2 and dosing head 1 is not upright, but is for instance being held horizontally or even upside down, a liquid seal 8 is arranged according to the invention between aerating opening 6 and container 2. This liquid seal 8 comprises an aerating channel 15 rotated twice through 180°, which in the shown embodiment is formed by two protruding tubes 16, 17, which are integrated into two parts 18, 19 to be connected to each other. These two parts are here clamped into each other, wherein the one part 19 is formed integrally with the side of dosing head 1 directed toward container 2 and protrudes into the neck of container 2.

In the shown embodiment the assembly is adapted for a snap connection which can be released in the manner of a bayonet fitting as described in WO 02/42006. The neck of container 2 is therefore provided here with three lugs 20, 21 for co-action with recesses 22, 23 in dosing head 1.

The part 18 of liquid seal 8 forms a tray substantially closed toward container 2 and having only the mouth of tube part 16 in its bottom. Part 18 further comprises a co-moulded element 24, in which a throughfeed channel 25 is defined into which dip tube 14 can be inserted. This element 24 also has an opening 26 which is remote from the container and which forms part of a secondary inlet channel 10 to be described hereinbelow.

As stated, the other part of upper part 19 forms an integral part of dosing head 1, and has around the tubular channel part 17 a peripheral wall 27 and a partition wall 28 around aerating opening 6.

The tubular channel parts 16, 17 are dimensioned and assembled such that a precisely defined restriction in the form of an annular gap 32 is formed between the free end edge of tube part 17 and the bottom of tube part 16.

Since there is the danger that dip tube 14 can no longer draw in liquid when the assembly is being used in upside down position, according to another aspect of the invention a secondary inlet opening 29 can be provided, which is closable by a movable closing element 30, in the shown embodiment a ball, under the influence of the force of gravity. This secondary inlet opening 29 here forms part of secondary inlet channel 10, which is defined by the co-moulded element 24 of part 18 in combination with a second part 9, which can be clamped between this element 24 and inlet opening 4 of dosing head 1.

This second part 9 comprises an inflow chamber 33, in which ball 30 is accommodated with clearance. Secondary inlet opening 29 is formed in the end wall 34 of this chamber 33 directed toward container 2. Side walls 35 of the inflow chamber have inflow openings 36. The second part 9 also comprise an edge 37 which engages round an edge around opening 26 of element 24, which forms a wall of secondary inlet channel 10.

Secondary inlet channel 10 also comprises an outlet part 38 which protrudes into inlet opening 4 of dosing head 1. This outlet part lies in line with throughfeed channel 25 and dip tube 14. Another constriction 39 is also formed at the end of throughfeed channel 25, whereby the throughflow area of this channel is smaller than that of secondary inlet opening 29.

The operation of liquid seal 8 is now as follows. When the assembly of container 2 and dosing head 1 is upright and piston 12 occupies its rest position, aerating channel 15 is closed on the top side and is in contact with container 2 on the underside. Channel 15 is filled with air.

If the assembly is now turned upside down, aerating channel 15 partly fills with fluid. Because aerating opening 6 is still closed by lip 7 of piston 12, the air present therein cannot escape, but is compressed. The liquid will thus for instance only penetrate into first tube part 16, and possibly into the space bounded by tube parts 16 and 17 but, partly due to the presence of restriction 31, will not reach aerating opening 6, which is moreover screened by partition wall 28.

When pump 5 is now operated by squeezing trigger 13, piston 12 is moved inward and aerating opening 6 is left clear. In principle, liquid could now begin to flow through aerating channel 15. Through pumping of the liquid an underpressure is however simultaneously generated in container 2, whereby the liquid from aerating channel 15 is drawn back into container 2, followed by air from aerating opening 6. Leakage through aerating opening 6 is thus prevented.

The operation of the optionally present secondary inlet opening 29 is as follows. When the assembly of container 2 and dosing head 1 is upright, secondary inlet opening 29 is closed by ball 30 which rests on an edge of opening 29 under the influence of gravity. When pump 5 is operated in this position, an underpressure develops in container 2 whereby ball 30 is sucked fast to the edge and secondary inlet opening 29 is sealed hermetically, thus preventing air being drawn out of container 2.

If the assembly is turned upside down, ball 30 drops into inflow chamber 33. Secondary inlet opening 29 is then left clear and liquid can flow through inflow openings 36 into inflow chamber 33 of secondary inlet channel 10. From here, after passing through secondary inlet opening 29 and changing direction again through 180°, the liquid flows via outlet part 38 and to inlet opening 4 of the dosing head.

When the assembly of container 2 and dosing head 1 does not have to be used in upside down position, but for instance only in horizontal position, the use of a secondary inlet channel and a secondary inlet opening can be dispensed with. Dip tube 14 can then be directed downward such that it is always situated in the liquid. In this case the co-moulded element 24 and part 9 are omitted, and dip tube 14 is inserted directly into inlet opening 4. In this case the sealing ball 30 can of course also be omitted.

In an alternative embodiment of the invention (FIG. 12) liquid seal 108 and secondary inlet channel 110 are wholly manufactured as separate components which can be releasably connected to dosing head 101 on one side and container 102 on the other. Liquid seal 108 can thus be added to an existing design of an assembly of container 102 and dosing head 101 without further modifications being necessary for this purpose. liquid seal 108 again consists of two parts 118, 119 which can be clamped into each other and which have co-acting tube parts 116, 117.

In order to then be able to use liquid seal 108 in combination with a snap/rotation connection as according to WO 02/42006, part 118 is provided with three lugs 120, 121 for co-action with recesses in dosing head 101, and three recesses 122, 123 for co-acting with lugs on the neck of container 102. Liquid seal 108 could of course also have other connecting means if dosing head 101 were for instance screwed onto container 102.

In this variant of the invention the part 118 of liquid seal 108 has adjacently of the mouth of tube part 116 a widened opening 124 which is connected to a throughfeed channel 125, and an opening 126 which forms part of secondary inlet channel 110. The top part 119 has the form of a cover from which, in addition to channel part 17, there protrudes only a part 27 of secondary inlet channel 10 closed on the top side. A passage opening 128 for throughfeed channel 125 of component 118 is further formed in the cover.

In this variant the secondary inlet channel 110 is defined by part 18 in combination with a third separate component 109, which can be clamped in the widened opening 124. This third component 9 comprises a passage 111 which is widened on the underside and narrowed on the top side and into which dip tube 114 can be inserted. Part 109 also comprises an upper surface 131 which forms a wall of secondary inlet channel 110.

Liquid seal 8, optionally in combination with secondary inlet opening 29, enables the use of an assembly of dosing head 1 and container 2 in non-vertical position, wherein container 2 can still be adequately ventilated and there is no risk of air being drawn in from container 2. Due to the embodiment as separate component the liquid seal can be readily integrated into an existing design of container and dosing head. The embodiment in a small number of easily assembled components results in a low cost price.

The invention is not limited to the embodiment above, but is defined solely by the claims.

The invention claimed is:

1. Dosing head for dispensing a fluid from a container, comprising:

at least one inlet opening for connecting to the container;

at least one outlet opening connected to the inlet opening via a conduit; and at least one piston received in the conduit and at least one aerating opening for connecting to the container, wherein a liquid seal is arranged between the aerating opening and the container, wherein the liquid seal comprises an aerating channel rotated at least twice through about 180 degrees between the aerating opening and the container, and wherein, a portion of the aerating channel following the first about 180 degree rotation but prior to the second about 180 degree rotation is significantly narrowed, being most narrow at a point of said channel that is vertically remote from the aerating opening.

2. Dosing head as claimed in claim 1 wherein the liquid seal has at least one constriction at said point vertically remote from the aerating opening.

3. Dosing head as claimed in claim 1, wherein the liquid seal is assembled from at least two mutually connected parts.

4. Dosing head as claimed in claim 3, wherein each of the parts has a bottom, a side wall and a tubular part protruding from the bottom, wherein the tubular parts fit into each other with clearance, and wherein the bottom of the one part has an opening outside the periphery of the tubular part and the bottom of the other part has an opening inside the periphery of the tubular part.

5. Dosing head as claimed in either of claims 1 and 4, wherein the pump, the inlet opening, the outlet opening and the conduit are formed as one component, and one of the parts of the liquid seal is integrated into said one component.

6. Dosing head as claimed in either of claims 1 and 3, wherein a restriction is defined between component parts of the liquid seal.

7. Dosing head as claimed in claim 1, wherein the liquid seal is releasably connected to the dosing head.

8. Dosing head as claimed in claim 1, further comprising a secondary inlet opening connected to the container and closable by means of an element which can be operated by gravity.

9. Dosing head as claimed in claim 8, wherein the secondary inlet opening is accommodated in a secondary inlet channel rotated at least twice through about 180°.

10. Dosing head as claimed in claim 9, wherein the secondary inlet channel has an inflow chamber in which the closing element is received in freely movable manner with clearance, and wherein the inflow chamber comprises an end wall which is directed toward the container and in which the secondary inlet opening is defined.

11. Dosing head as claimed in either of claims 9 and 10, wherein the secondary inlet channel comprises an outlet part which is connected to the inlet opening.

12. Dosing head as claimed claim 11, wherein constriction is formed between the primary inlet opening and the container, the cross sectional area of said constriction being smaller than that of the secondary inlet opening.

13. Dosing head as claimed either of claims 9 and 10, wherein a constriction is provided between the inlet opening and the container, the cross sectional area of said constriction being smaller than that of the secondary inlet opening.

14. Dosing head as claimed in either of claims 9 and 10, wherein at least a part of the secondary inlet channel is connected releasably to the dosing head.

15. Dosing head as claimed in claim 14, wherein at least a part of the secondary inlet channel is connected releasably to components forming the liquid seal.

16. Dosing head as claimed in claim 15, wherein the part of the secondary inlet channel is clamped between a part of the components forming the liquid seal and the inlet opening.

17. Dosing head as claimed in claim 1, wherein the aerating opening is isolated from a remainder of the aerating channel by a partition wall.

* * * * *

UNITED STATES PATENT AND TRADEMARK OFFICE

CERTIFICATE OF CORRECTION

PATENT NO. : 8,561,852 B2
APPLICATION NO. : 11/909070
DATED : October 22, 2013
INVENTOR(S) : Maas et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1449 days.

Signed and Sealed this
Fifteenth Day of September, 2015

Michelle K. Lee

Michelle K. Lee
*Director of the United States Patent and Trademark Office*